United States Patent [19]

Pommier et al.

[11] 4,009,410

[45] Feb. 22, 1977

[54] CATHODE-RAY TUBES ELECTRON-GUNS

[75] Inventors: Claude Pommier; Andre Albertin, both of Paris, France

[73] Assignee: Thomson-CSF, Paris, France

[22] Filed: Sept. 20, 1973

[21] Appl. No.: 399,095

[30] Foreign Application Priority Data

Sept. 26, 1972 France ..... 72.34000

[52] U.S. Cl. ..... 313/411; 315/16

[51] Int. Cl.[2] ..... H01J 29/50

[58] Field of Search ..... 313/83 R, 85, 70, 446, 313/251, 409, 411, 414, 449; 315/14, 15, 16

[56] References Cited

UNITED STATES PATENTS

| | | | |
|---|---|---|---|
| 2,367,130 | 1/1945 | Klemperer | 313/449 |
| 2,975,315 | 3/1961 | Szegho | 313/83 |
| 3,008,064 | 11/1961 | Niklas et al. | 313/449 |
| 3,090,882 | 5/1963 | Benway | 313/449 |
| 3,798,478 | 3/1974 | Say | 313/414 |
| 3,798,478 | 3/1974 | Say | 313/83 |

*Primary Examiner*—R. V. Rolinec
*Assistant Examiner*—Ernest F. Karlsen
*Attorney, Agent, or Firm*—Roland Plottel

[57] ABSTRACT

An electron-gun for cathode-ray tubes comprising, by comparison with prior art guns, at least one supplementary electrode (6) of the diaphragm type, arranged between the accelerator grid (3) and the anode (4) of such gun, and placed at a positive potential lower than that of said anode, forming with the entry of said anode a second condenser lens influencing the electron-beam (F) to produce a second cross-over ($C_2$) and utilisable in particular for multicolor cathode-ray tubes.

4 Claims, 15 Drawing Figures

V4 = 14 kV
V4 = 10 kV
V4 = 6 kV
1
2
3
4
5
6
7
A
C1
C2
F

PRIOR ART
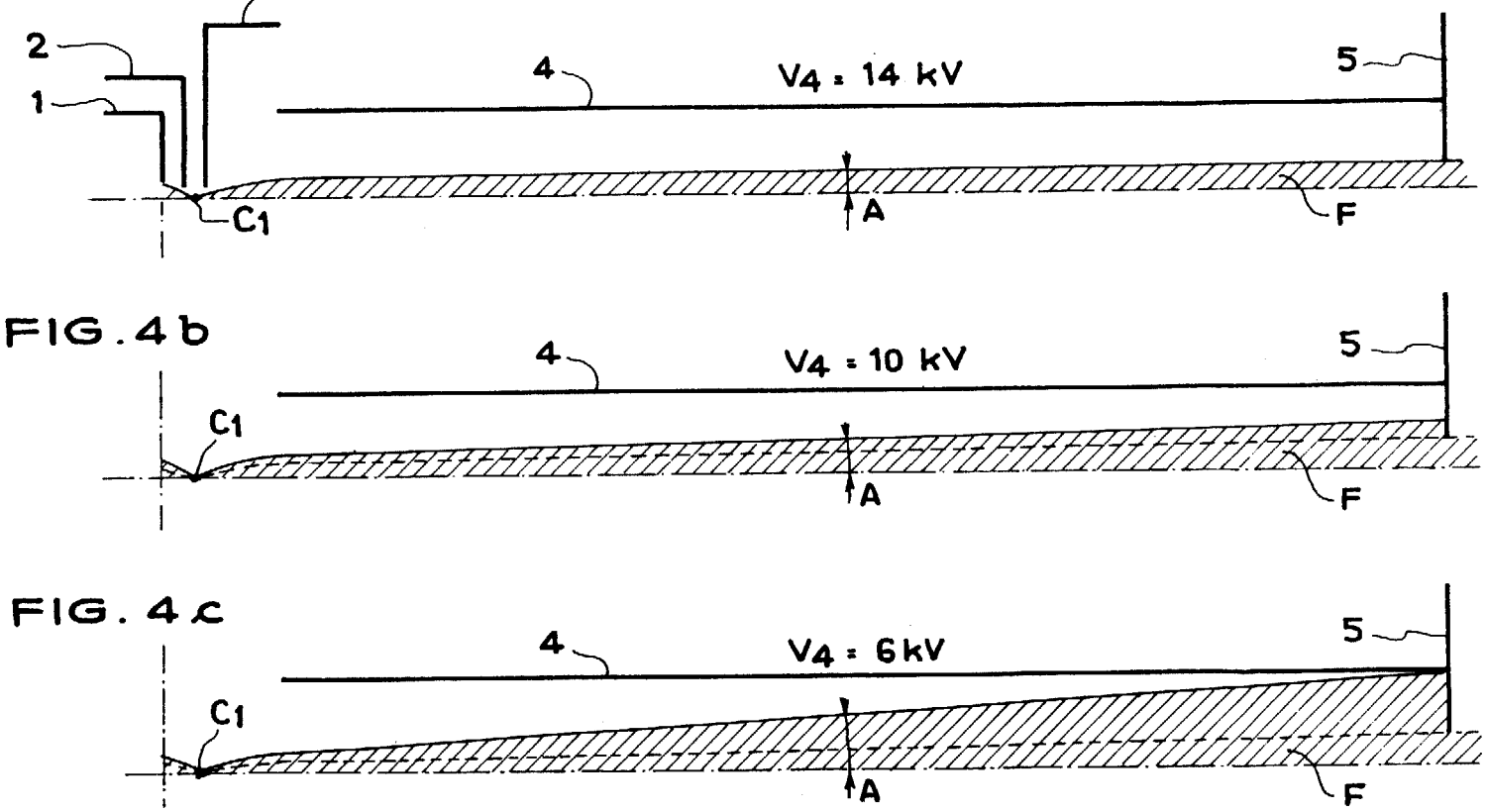

CATHODE-RAY TUBES ELECTRON-GUNS

The present invention relates to improvements in the electron-guns of cathode-ray tubes. It relates more particularly to guns having improved efficiencies in relation to those of prior art guns, and capable of furnishing substantially parallel electron-beams whilst nevertheless maintaining said improved efficiency characteristics.

The conventional make-up of an electron-gun, is as follows. In an evacuated enclosure, there are disposed in succession: an electron source or cathode at zero potential; a cylindrical electrode or modulating electrode, surrounding the cathode enclosed by a diaphragm containing a hole some few tenths of a millimetre in diameter, this electrode being placed at a negative, variable potential in order to control the beam current; a first acceleration grid, generally referred to as the acceleration grid, constituted by a diaphragm containing a hole having the size of the same order of magnitude as that in the modulating electrode and placed at a positive potential; accelerating electrodes or anodes placed at positive potentials which are higher than the last-mentioned one, generally constituted by an elongated cylinder possibly terminated at one of its ends, or for that matter at both, in a diaphragm; and an electrostatic or electromagnetic focussing system.

The electron-beam, emitted by the cathode and intensity-modulated by the modulating electrode, passes through the electrostatic lens constituted by the modulating electrode and the accelerator grid followed by the anode. This lens produces an electronic image of the cathode, of very small dimensions and generally referred to as the cross-over, between the modulating electrode and the accelerator grid. The electron trajectories then diverge from this point over the whole of their path to the anode, this divergency being the greater the lower the voltage applied to the anode.

The result is that it is practically impossible to produce cylindrical electron-beams using such guns, that is to say beams in which the rays are parallel to the axis. Moreover, in guns of this kind the efficiency varies with the cathode current, and this can be a major source of nuisance in certain application; this efficiency is on the other hand the lower, the lower the potential applied to the accelerator anode. All these features can render these guns difficult to use; this is for example the case where they form part of multicolour cathode-ray tubes in which colour variation is produced by variation of the penetration of the beam into the different phosphorus layers constituting the screen.

It is worthy of note that certain types of guns, the Pierce type for example, make it possible to produce beams with substantially parallel rays; however, they do not exhibit the efficiency characteristics of the guns in accordance with the present invention.

The object of the invention is to produce electron-guns which exhibit improved efficiency characteristics and furnish electron-beams which can be cylindrical. Guns of this kind can be utilised in any cathode-ray tube; they are particularly relevant to applications in multicolour cathode-ray tubes.

In accordance with the invention, improved electron-guns are produced by the addition to conventional guns of at least one supplementary electrode or diaphragm, located between the accelerator grid and the anode and placed at a positive potential of the order of magnitude of that applied to the accelerator grid, said diaphragm constituting, in association with the anode aperture, a second electrostatic condenser lens, producing a second cross-over in the electron-beam.

The position of said second cross-over of the beam axis depends upon the potential of the anode; for a given value, this cross-over is displaced to infinity and the beam is cylindrical.

An electron-gun for cathode-ray tubes according to the invention comprising:

a cathode, a modulating electrode, an accelerator grid constituting, with said modulating electrode, a first condenser lens producing in the electron-beam emitted by the cathode, a first cross-over, at least one cylindrical accelerator anode terminated, at the end opposite to said cathode, in a diaphragm placed at the same potential as said anode and followed by a focusing system, and at least one supplementary electrode of the diaphragm type, arranged between said accelerator grid and said anode and placed at a positive potential lower than that of said anode, and constituting with the opening in said anode, close to said supplementary electrode (6), a second condenser lens forming a second cross-over in the electron-beam.

For a better understanding of the present invention, together with other and further objects, advantages and capabilities thereof, reference is made to the following disclosure and appended claims in connection with the accompanying drawings in which:

Figures 3A, 3B, 3C:
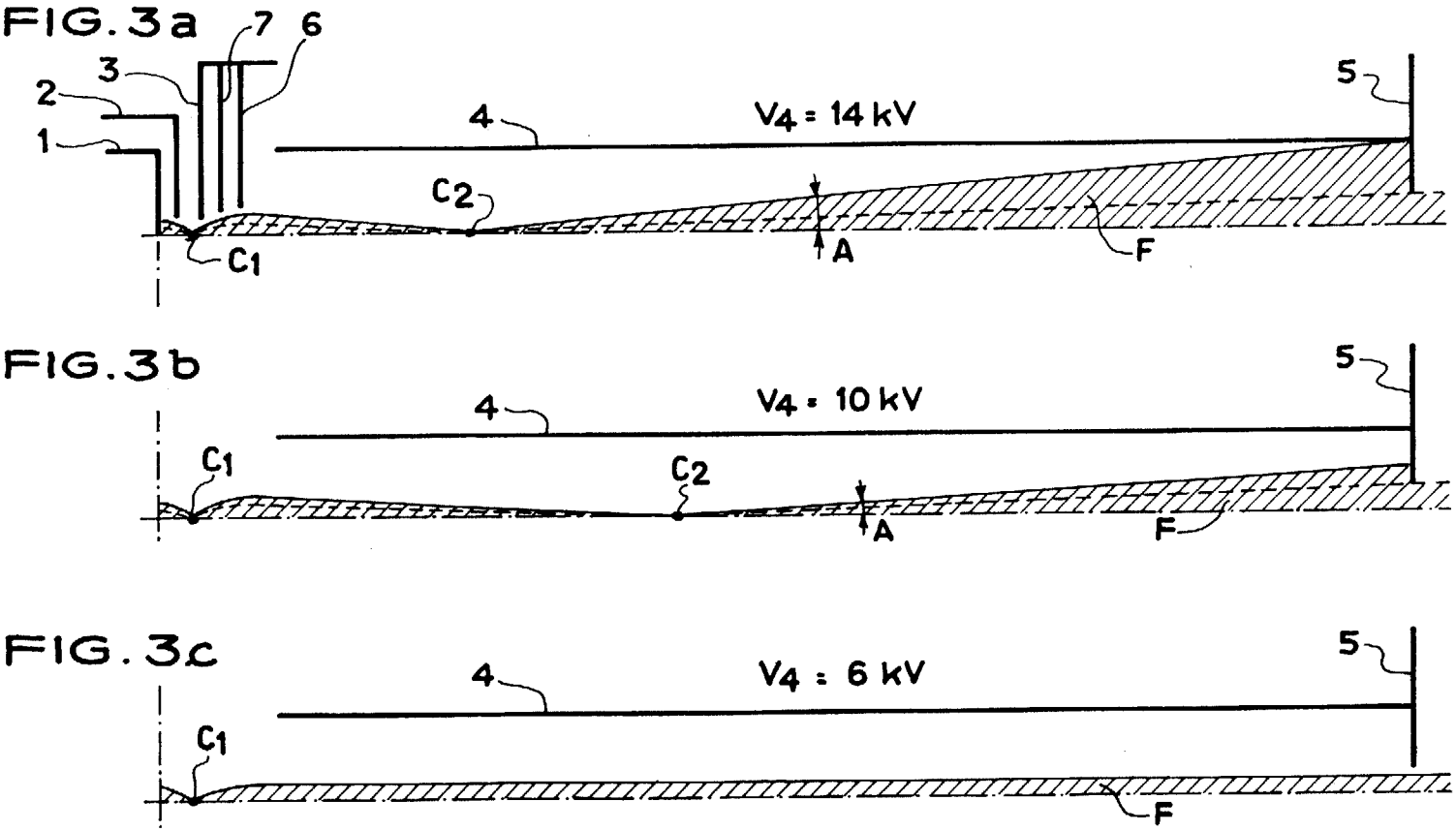
Figure 5:
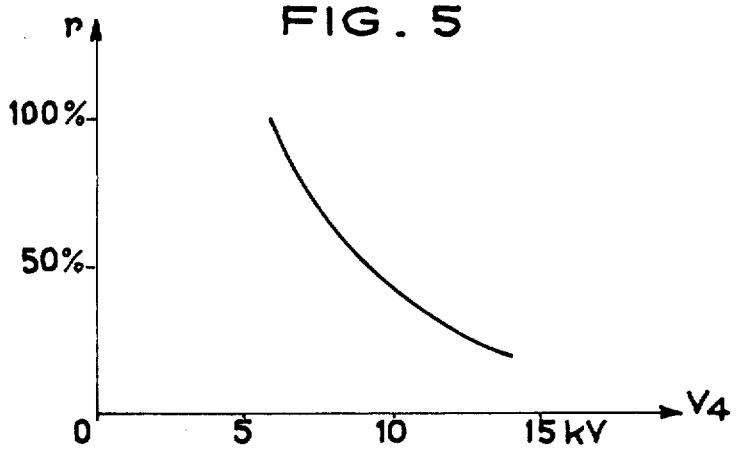
Figure 6:
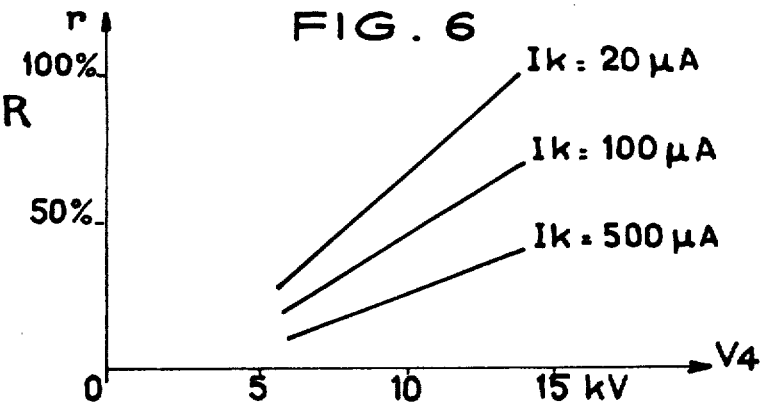
FIG. 6 PRIOR ART
Figure 7:
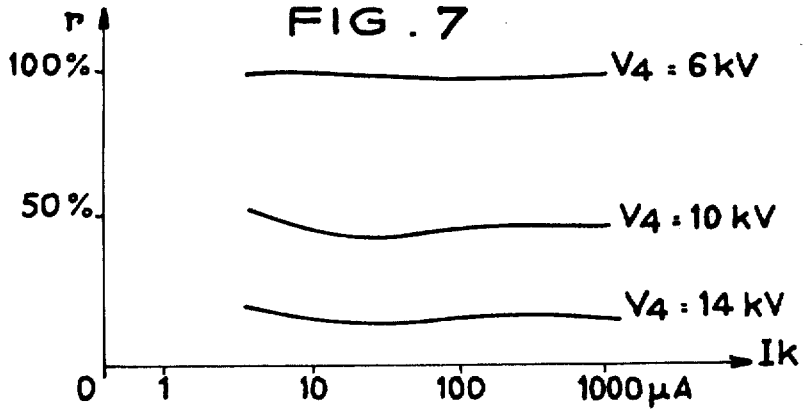
Figure 8:
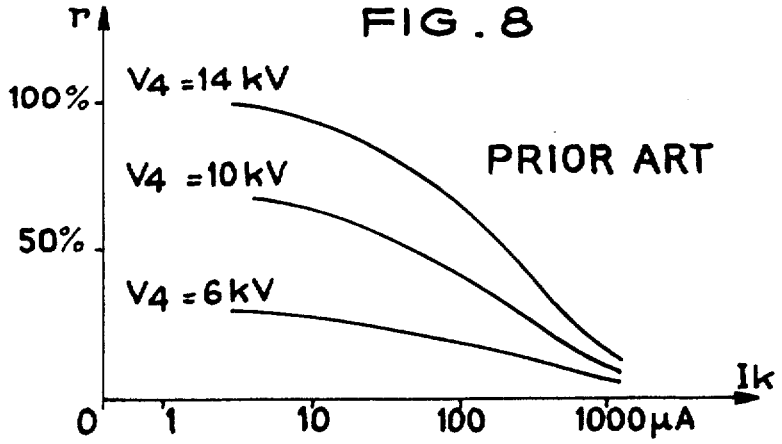
Figure 9:
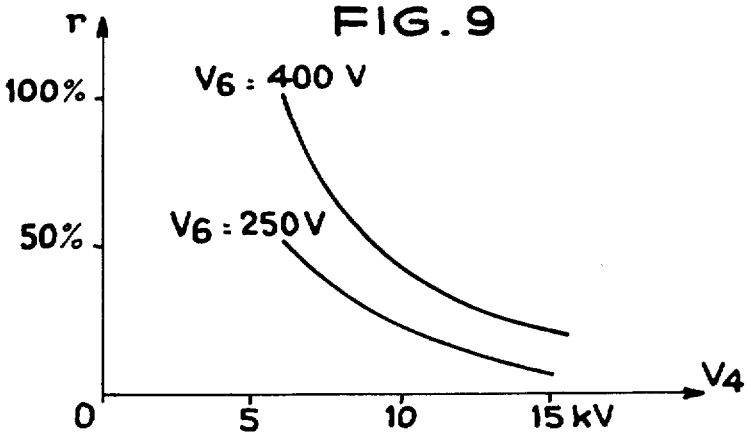
Figure 10:
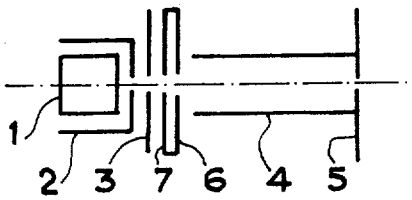
Figure 11:
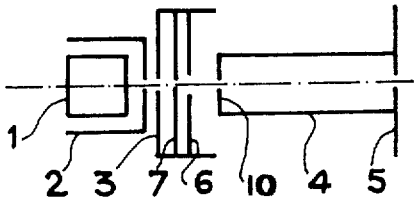

FIGS. 3*a*, 3*b* and 3*c* are fragmentary illustrations of the relevant part of a gun in accordance with the invention, showing its mode of operation for different values of anode voltage;

FIGS. 4*a*, 4*b* and 4*c* are illustrations similar those of FIGS. 3*a*, 3*b* and 3*c*, for a prior art gun;

FIGS. 5 and 6 plot graphs showing the variation in gun efficiency respectively in accordance with the invention and in accordance with the prior art, as a function of anode potential;

FIGS. 7 and 8 are graphs showing the variation in efficiency of the gun respectively in accordance with the invention and in accordance with the prior art gun, as a function of cathode current;

FIG. 9 illustrates graphs plotting the efficiency of the gun in accordance with the invention, as a function of anode potential, for two different values of the potential on the supplementary diaphragm in accordance with the invention;

FIGS. 10 and 11 are schematic illustrations of variant embodiments of guns in accordance with the invention.

Figure 1:
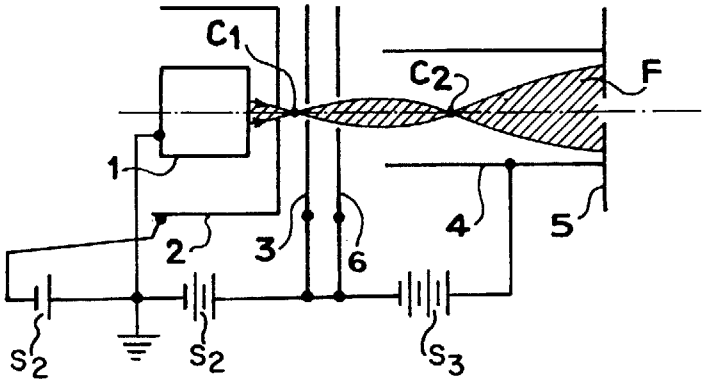
FIG. 1 is a highly simplified diagram of the novel part of an electron-gun in accordance with the invention.

FIG. 1 illustrates highly schematically the essential part of an improved electron-gun in accordance with the invention, in a particularly simple embodiment. The biasing means providing convenient biasing potentials to the different electrodes are schematically represented by d.c. supply means S1, S2, S3, the cathode 1 being at the reference potential.

The electrodes which conventionally constitute an electron gun are, as already explained: The cathode 1, the modulating electrode 2, the accelerator grid 3 and the cylindrical anode 4, here terminated by a diaphragm 5 placed at the same potential as said anode.

The electron-beam F emitted by the cathode passes through the first electrostatic lens which is constituted by the modulating electrode 2 and the grid 3, resulting in the production of the first cross-over $C_1$.

The supplementary electrode which is embodied in the guns in accordance with the invention, is constituted by the diaphragm 6. The central opening in the diaphragm 6 has a diameter slightly greater than those of the openings in the grid 3 and the modulating electrode 2, these latter two being substantially identical in size to each other. The potential to which the diaphragm is raised is a positive potential which may be equal to or slightly different from that of the grid 3, as will be explained hereinafter; at all events, it is less than the potential of the anode 4.

The diaphragm 6 constitutes, with the opening in the anode 4, a second electrostatic condenser lens the greater or lesser degree of convergence produced by which is a function of the potential $V_4$ of the anode 4 (FIGS. 3*a*, 3*b* and 3*c* hereinafter), giving rise to the formulation of a second crossover $C_2$ whose presence makes it possible to achieve the improved characteristics explained hereinafter.

Figure 2:
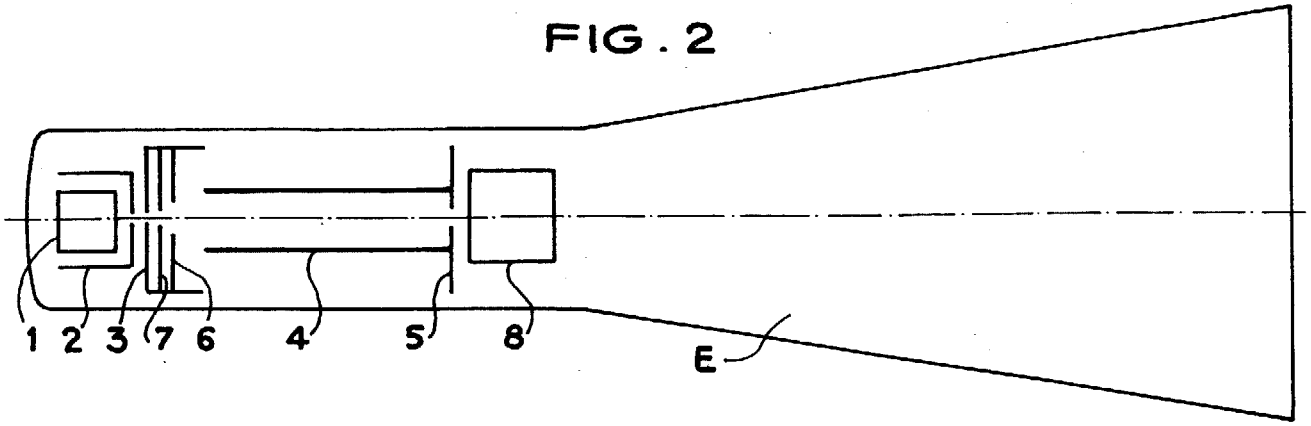
FIG. 2 is a very highly simplified sectional view of a cathode-ray tube equipped with an electron-gun in accordance with the invention.

FIG. 2 is a highly schematic illustration of an embodiment of an electron gun in accordance with the invention, fitted to a cathode-ray tube. Within the sealed enclosure or envelope E containing the different elements of the tube, there can be seen the cathode 1, the modulating electrode 2, the accelerator grid 3, the anode 4 and its diaphragm 5, and the diaphragm 6 in accordance with the invention.

Two differences in design will be apparent here, in relation to the basic diagram shown in FIG. 1. There is a second diaphragm 7 between the grid 3 and the diaphragm 6 belonging to the second lens. Said second diaphragm 7, whose central opening has a smaller diameter than that in the diaphragm 6, is principally intended to prevent the electric field penetrating to the opening of the diaphragm 6, from extending too far towards the cathode 1 and thus modifying the formation of the first cross-over $C_1$.

The second difference resides in the fact that these two diaphragms are electrically connected to the grid 3 to which they are fixed; in this case, the three electrodes are at the same potential.

A conventional focussing system 8, electrostatic or electromagnetic and not involved in any particular original way in the operation of the gun in accordance with the invention, has been schematically illustrated at 8. The other electrodes of the tube have not been shown, since they do not form part of the electron-gun; they are designed in the conventional fashion and depend upon the particular tube type. The bias sources have not been shown either, simply in order not to overburden the figure. They are connected to the electrodes in an entirely conventional way.

FIGS. 3*a*, 3*b* and 3*c* which schematically illustrate the top half of an electron-gun such as that shown in FIG. 2, for three different values of the potential $V_4$ applied to the anode, make it possible to follow the trajectory of the rays of the electron-beam F issuing from the cathode 1, and see how the second cross-over $C_2$ in accordance with the invention, is formed. The half-electrodes 1, 2, 3, 6 and 7 have been shown in FIG. 3*a* only; they are of course identical for FIGS. 3*b* and 3*c*.

For a high anode potential, $V_4 = 14{,}000$ volts for example (FIG. 3*a*), the second lens formed, in accordance with the invention, by the diaphragm 6 and the opening of the anode 4, is highly convergent and the second cross-over $C_2$ is quite close to the entrance of the anode. The apertural half-angle A of the beam F after the point $C_2$, is quite large and the diaphragm 5 only allows a small part of the beam to pass; consequently, the efficiency of the gun is quite poor.

For a slightly lower potential, $V_4 = 10{,}000$ volts for example (FIG. 3*b*), the lens is less convergent and the crossover $C_2$ is nearer the diaphragm 5. The appertural half-angle A thus being smaller, the diaphragm 5 does not block off the beam F to such an extent and the gun efficiency is better.

Finally, for a still lower anode potential, $V_4 = 6000$ volts for example (FIG. 3*c*) the cross-over $C_2$ is displaced practically to infinity, the beam F becoming cylindrical and the appertural half-angle zero. With operation under these conditions, the diaphragm 5 allows the whole of the beam F to pass and the gun efficiency is maximum (close to 100%).

FIGS. 4*a*, 4*b* and 4*c* are equivalent to FIGS. 3*a*, 3*b* and 3*c* respectively, but correspond to a prior art gun, without a diaphragm 6 to form a second lens, or a diaphragm 7. It is clear that here there will be no formation of a second crossover, and this is understandable enough since there is only one condenser lens, that constituted by the electrodes 2 and 3, and there will not therefore be any formation of a cylindrical beam. As far as the aperture of the beam F is concerned, as represented by the appertural half-angle A, it increases as the anode potential diminishes; the result is that the gun efficiency decreases as the anode potential $V_4$ decreases, this being the opposite to what happens in the guns in accordance with the present invention.

The comparative performances of guns in accordance with the present invention and those of prior art design, are very clearly visible from the consideration of the ensuing figures.

FIGS. 5 and 6 illustrate the graphs plotting efficiency r as a function of the anode potential $V_4$, respectively for the gun in accordance with invention and a prior art gun. These graphs vary in opposite senses. Further, whilst the efficiency of the prior art guns (FIG. 6) is a function of the cathode current Ik of the gun, this is not so in the case of the guns in accordance with the invention.

These properties of the two types of gun are clearly apparent from the graphs of FIGS. 7 and 8 which represent the variations in the efficiency r respectively for a gun in accordance with the invention (FIG. 7) and a prior art gun (FIG. 8) as a function of the cathode current Ik, for different values of the anode potential $V_4$.

Finally, FIG. 9 which illustrates the variations in the efficiency r of a gun in accordance with the invention, as a function of the anode potential $V_4$, shows that if the potential $V_6$ of the diaphragm 6 is varied, the gun efficiency varies too, for a given value of the potential $V_4$. This property is specific to the guns in accordance with the invention; it does not exist in prior art guns. It is significant since it constitutes a simple means of adjusting the gun efficiency to the desired level, without having to vary the anode potential.

FIGS. 10 and 11 schematically illustrate two variant embodiments of the gun shown in FIG. 2, both in accordance with the basic diagram of FIG. 1.

In the gun shown in FIG. 10, the diaphragms 6 and 7 are connected together, but are isolated from the accelerator grid 3. This variant embodiment is significant since it makes it possible to vary the potential $V_6$ applied to the two diaphragms 6 and 7, and consequently to adjust the efficiency of the gun as stated in relation to FIG. 9, without varying the potential of the accelerator grid 3 and consequently without varying the blocking voltage of the tube.

Finally, in the embodiment shown in FIG. 11, a diaphragm 10 is arranged at the entry of the anode 4. The anode potential $V_4$ value for which the beam F is cylindrical, depends upon several gun parameters, the different applied potentials and its geometry for example; it depends in particular upon the apperture presented by the anode 4 to the beam passing through it. The presence of the diaphragm 10 and the choice of the diameter of its apperture, make it possible to adjust the working point.

The guns in accordance with the invention, certain embodiments of which have been described hereinbefore, can advantageously be utilised in a variety of applications. One particularly significant application is that already mentioned, concerned with multicolour cathode-ray tubes.

In tubes of this kind, the screen is constituted by several layers of fluorescent material each emitting light of a different wavelength, under the effect of electron-bombardment. The variation in the colour of the image observed is obtained by a variation in the depth of penetration of the electrons accelerated by the potential of the gun anode. This depth depends upon the velocities of the electrons, and these are again proportional to the square root of the potential. Thus, the colour variation is obtained by varying the potential of the anode of the electron-gun. In a classic example of a tube of this kind, changing from red to green, the colour red is conventionally obtained at the lowest anode potential (7,000 volts for example) and the colour green at the highest potential (13,000 volts for example). The brilliance of the screen, at constant beam current, is then less when displaying red than when displaying green, because of the variation in the energy of the electrons, to which there is added the different sensitivity of the human eye to the various wavelengths of the spectrum. To compensate for this phenomenon, it is necessary to utilise a higher beam current for the load anode potentials.

In the prior art guns, it has been seen, in particular from FIG. 8, that the efficiency decreases markedly as the cathode current rises. It is thus necessary, in order for the image to be correct nevertheless, in the red, to utilise an even higher cathode current and this has numerous drawbacks: the focussing is difficult to achieve when displaying red; the service life of the cathode is reduced; the modulation differs in accordance with the colour and the input circuit to the modulating electrode becomes complex. However, as explained since the efficiency is not constant as a function of the cathode current, the modulation of the tube brilliance will not be linear, and this can be a nuisance in certain applications.

By contrast, with the improved guns in accordance with the invention, where the efficiency is virtually constant, irrespective of cathode current variation, see FIG. 7 in particular, the increase in beam current required in the red part of the spectrum, is obtained automatically by reduction in the anode potential. It is not necessary to change the adjustment of the gun to increase the cathode current in the way that was necessary in the prior art guns. Thus, better image definition, a constant cathode current and constant modulation, are achieved, making things much simpler. Moreover, the brilliance modulation is a linear function of the cathode current.

Of course, the invention is not limited to the embodiments described and shown, which were given solely by way of example.

What is claimed is:

1. An electron-gun for cathode ray tubes, comprising:

a cathode for emitting an electron-beam;

an apertured modulating electrode; means for connection to a biasing source for biasing said modulating electrode negatively relative to said cathode; said modulating electrode controlling the intensity of said electron-beam;

accelerator means comprising an apertured accelerator grid and at least one cylindrical anode; the central aperture of said accelerator grid having substantially the same dimensions as the central aperture of said modulating electrode; said cylindrical anode being terminated at its end opposite to said cathode in a diaphragm which is maintained at the same potential as said anode;

means for connecting said accelerator grid and said at least one cylindrical anode to a biasing source for positively biasing said grid and anode relative to said cathode, and with said cylindrical anode being more positive than said accelerator grid;

said modulating electrode constituting with said accelerator grid a first condenser lens producing a first cross-over (C1) in said electron-beam and at least one supplementary electrode of the diaphragm type, arranged between said accelerator grid and said anode, the central aperture of said supplementary electrode having dimensions slightly greater than those of the central aperture of said modulating electrode, and said supplementary electrode being connected to connecting means for biasing said electrode at a potential positive relative to said cathode and lower than that of said anode;

said supplementary electrode constituting with the adjacent opening in said anode, a second condenser lens forming a second cross-over (C2) in said electron beam.

2. An electron-gun for cathode ray tubes, comprising:

a cathode for emitting an electron-beam;

an apertured modulating electrode; means for connection to a biasing source for biasing said modulating electrode negatively relative to said cathode; said modulating electrode controlling the intensity of said electron-beam;

accelerator means comprising an apertured accelerator grid and at least one cylindrical anode; the central aperture of said accelerator grid having substantially the same dimensions as the central aperture of said modulating electrode; said cylindrical anode being terminated at its end opposite to said cathode in a diaphragm which is maintained at the same potential as said anode;

means for connecting said accelerator grid and said at least one cylindrical anode to a biasing source for positively biasing said grid and anode relative to said cathode, and with said cylindrical anode being more positive than said accelerator grid;

said modulating electrode constituting with said accelerator grid a first condenser lens producing a first cross-over (C1) in said electron-beam and at least one supplementary electrode of the diaphragm type, arranged between said accelerator grid and said anode, the central aperture of said supplementary electrode having dimensions slightly greater than those of the central aperture of said modulating electrode, and said supplementary electrode being connected to connecting means for biasing said electrode at a potential positive relative to said cathode and lower than that of said anode;

said supplementary electrode constituting with the adjacent opening in said anode, a second condenser lens forming a second cross-over (C2) in said electron beam; and further comprising between said modulating electrode (2) and said supplementary electrode (6) an auxiliary diaphragm (7) whose central opening has a diameter less than that of the opening in said supplementary electrode (6), and which is placed at the same potential as the latter.

3. An electron-gun as claimed in claim 2, wherein said supplementary electrode (6) and said auxiliary diaphragm (7) are placed at the same potential as said accelerator grid (3).

4. An electron-gun as claimed in claim 1 wherein said cylindrical accelerator anode (4) comprises, at its end closest to the cathode (1) a diaphragm (10, in FIG. 11) at the same potential as said anode.

* * * * *